US010513869B2

(12) United States Patent
Crandall et al.

(10) Patent No.: US 10,513,869 B2
(45) Date of Patent: Dec. 24, 2019

(54) FENCE BRACE SYSTEM

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 0 days.

(21) Appl. No.: 16/004,248

(22) Filed: Jun. 8, 2018

(65) Prior Publication Data

US 2018/0291645 A1 Oct. 11, 2018

Related U.S. Application Data

(63) Continuation-in-part of application No. 14/863,793, filed on Sep. 24, 2015, now Pat. No. 10,030,408.

(51) Int. Cl.
*E04H 17/14* (2006.01)
*E04H 17/20* (2006.01)

(52) U.S. Cl.
CPC ..... *E04H 17/1421* (2013.01); *E04H 17/1413* (2013.01); *E04H 17/1434* (2013.01); *E04H 17/1443* (2013.01); *E04H 17/20* (2013.01); *E04H 2017/1473* (2013.01); *E04H 2017/1482* (2013.01)

(58) Field of Classification Search
CPC ..... E04H 17/1413; E04H 17/1417; E04H 17/1421; E04H 17/1426; E04H 17/143; E04H 17/17434; E04H 2017/1447; E04H 2017/1452; E04H 2017/1473
See application file for complete search history.

(56) References Cited

U.S. PATENT DOCUMENTS 949,394 A * 2/1910 Daly ..... E04B 1/2403
4,526,348 A * 7/1985 Cammack ..... E04H 17/1413 256/65.06
5,190,268 A * 3/1993 Espinueva ..... E04H 17/1421 256/65.01
5,657,967 A * 8/1997 Patrick ..... B29B 17/0042 256/19
6,802,496 B1 * 10/2004 Preta ..... E04H 17/1413 16/253
8,220,781 B2 * 7/2012 Gray ..... E04H 17/1421 256/65.02
8,966,857 B2 * 3/2015 Pope ..... E04B 1/2604 403/232.1
10,030,408 B2 * 7/2018 Crandall ..... E04H 17/1413

FOREIGN PATENT DOCUMENTS

GB 572653 * 10/1945 ..... E04H 17/1413
GB 677092 * 8/1952 ..... E04H 17/1413

* cited by examiner

*Primary Examiner* — Michael P Ferguson

(57) ABSTRACT

The present invention comprises a brace adapted to secure a fence rail to a fence post. The present invention brace may optionally be installed onto an existing fence or on a new fence. The invention includes a first fence rail brace member adapted to connect to two or more sides of a first fence rail, a second fence rail brace member adapted to connect to two or more sides of a second fence rail, and a fence post member adapted to connect to two or more sides of a fence post. The fence post brace member may form a vertical picket fastener slot, the first fence rail brace member may form a first horizontal picket fastener slot, and the second fence rail brace member may form a second horizontal picket fastener slot.

8 Claims, 3 Drawing Sheets

FENCE BRACE SYSTEM

CROSS-REFERENCES TO RELATED APPLICATIONS

This non-provisional utility application is a continuation-in-part (CIP) application of the pending U.S. application Ser. No. 14/863,793 titled "Fence Brace System" and originally filed Sep. 24, 2015, which is hereby incorporated in its entirety by reference.

BRIEF DESCRIPTION OF THE INVENTION

The present invention relates to the field of fences. More particularly, the present invention relates to a system for providing structural support for fences.

The present invention provides strength for building a new fence or repairing an existing fence. The fence would not need to be removed or modified to install the herein disclosed brace. Installation would be simple. The brace could be mass produced at low cost. The color and style of the brace could be easily adapted to match aesthetically with the fence and the surrounding area. The brace itself may be painted or stained. The brace may also be built into a new fence. The present invention optionally includes embodiments adapted for fences with rectanguloid rails or for rectanguloid fence posts. The present invention may be optionally optimized for a fence with cylindrical fence posts. The present invention may also include an embodiment adapted to secure the corner pieces of the fence. In an additional optional embodiment, the present invention is adapted to secure a fence on a slope. The brace may be made of strong weather-resistant material such as steel, stainless steel, galvanized steel, aluminum, plastic, graphite, composite material, or wood.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Fence and fence structure are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements. Despite the potential for damage, wood is still by far the most common residential fencing material in the United States. In 2007 alone, Americans put up 59,000 miles of wood fencing, enough to circle the globe twice. Wood is inexpensive and lightweight, and a wood fence can easily be shaped to give properties character and individuality. There are many styles, including linear post-and-rail and crisscrossing lattice, as well as myriad picket patterns and post-cap designs. And the wood may be painted or stained to match almost any landscape.

Fences could be built much stronger through the use of heavy materials such as steel and sturdy construction. However, this might drive the costs of the fence up above what is acceptable. As well, there are the aesthetic considerations discussed above. Also, it is unlikely that a property owner would replace an existing fence merely because of the possibility that it could be damaged by the elements.

There is an unmet need, therefore, for an inexpensive way to provide a fence with additional structural support. The need is especially great with respect to existing fences and with respect to wooden fences.

DETAILED DESCRIPTION OF THE INVENTION

Figure 2:
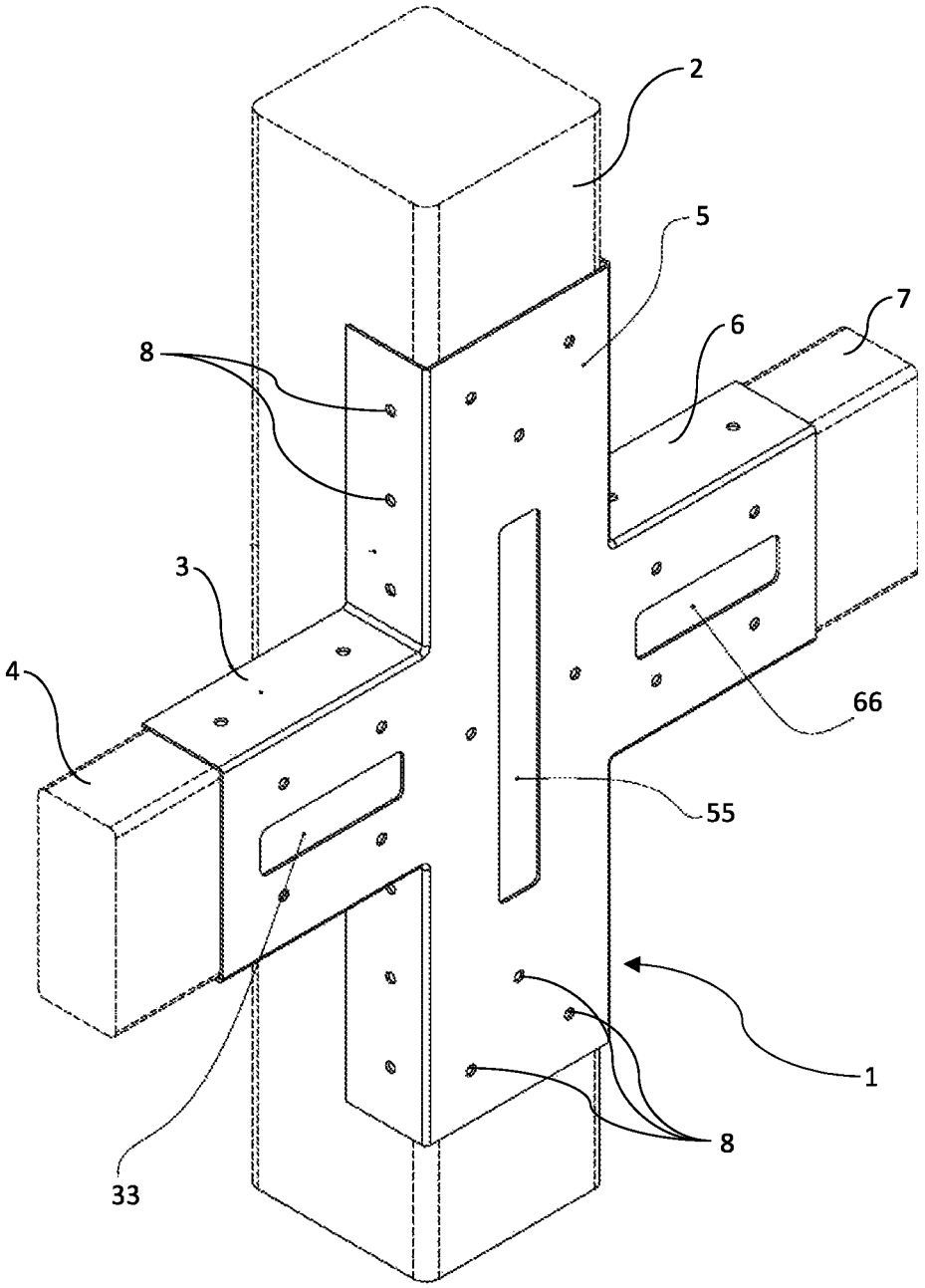
FIG. 2 illustrates an isometric view of a preferred embodiment of a fence brace, in accordance with the present invention.

In a preferred embodiment as illustrated in FIG. 2, the present invention comprises fence brace 1 for securing at least one fence rail 4 to fence post 2 including first fence rail brace member 3 adapted to connect to two or more sides of first fence rail 4. First fence rail brace member 3 may be fused to a first side of fence post brace member 5 wherein fence post brace member 5 is adapted to connect to two or more sides of fence post 2. The fence rail may be rectanguloid. As used herein, the term "rectanguloid" means a solid (3-dimentional) object which has six faces that are rectangles. It has the same cross-section along a length. As used herein, "rectanguloid" is the same as a rectangular prism. A rectanguloid may be though of as a 3-dimentional version of a rectangle or a square. The herein disclosed fence brace system may further include second fence rail brace member 6 fused to a second side of fence post brace member 5, wherein second fence rail brace member 6 is adapted to connect to two or more sides of second fence rail 7.

Fence brace 1 may include plurality of holes 8 thereby allowing fence post brace member 5 to be securely fastened to fence post 2 and thereby allowing first fence rail brace member 3 to be securely fastened to first fence rail 4 and second fence rail brace member 7 to be securely fastened to second fence rail 7. The plurality of holes may be referred to as screw-holes, nail holes, bolt holes, or other such holes. The plurality of holes may each receive a screw, a nail, a bolt, or an alternative type of fastener for securely connecting fence brace 1 to the fence post and/or the fence rail(s). The various figures illustrate the plurality of holes positioned in exemplary locations; those skilled in the art will recognize that the plurality of holes may be formed in various locations on the fence brace to provide the intended benefit of allowing secure attachment of the fence brace to the fence (the fence post and the fence rails).

Fence brace 1 may be formed of a strong weather-resistant material such as selected from the group consisting of steel, stainless steel, galvanized steel, aluminum, plastic, graphite, composite material, or wood.

An embodiment of the present invention may further include one or more slots for allowing one or more pickets (or boards) to be attached to the fence. For example, and as illustrated in FIG. 2 as a preferred embodiment, fence post brace member 5 forms vertical picket fastener slot 55, first fence rail brace member 3 forms first horizontal picket fastener slot 33, and second fence rail brace member 6 forms second horizontal picket fastener slot 66. This embodiment allows for attachment of a picket to fence post 2 through vertical picket fastener slot 55, attachment of a picket to first fence rail 4 through first horizontal picket fastener slot 33, and/or attachment of a picket to second fence rail 7 through second horizontal picket fastener slot 66. After fastening one or more pickets through the respective picket fastener slot, the herein disclosed fence brace is positioned in between the fence and the picket.

Figure 3:
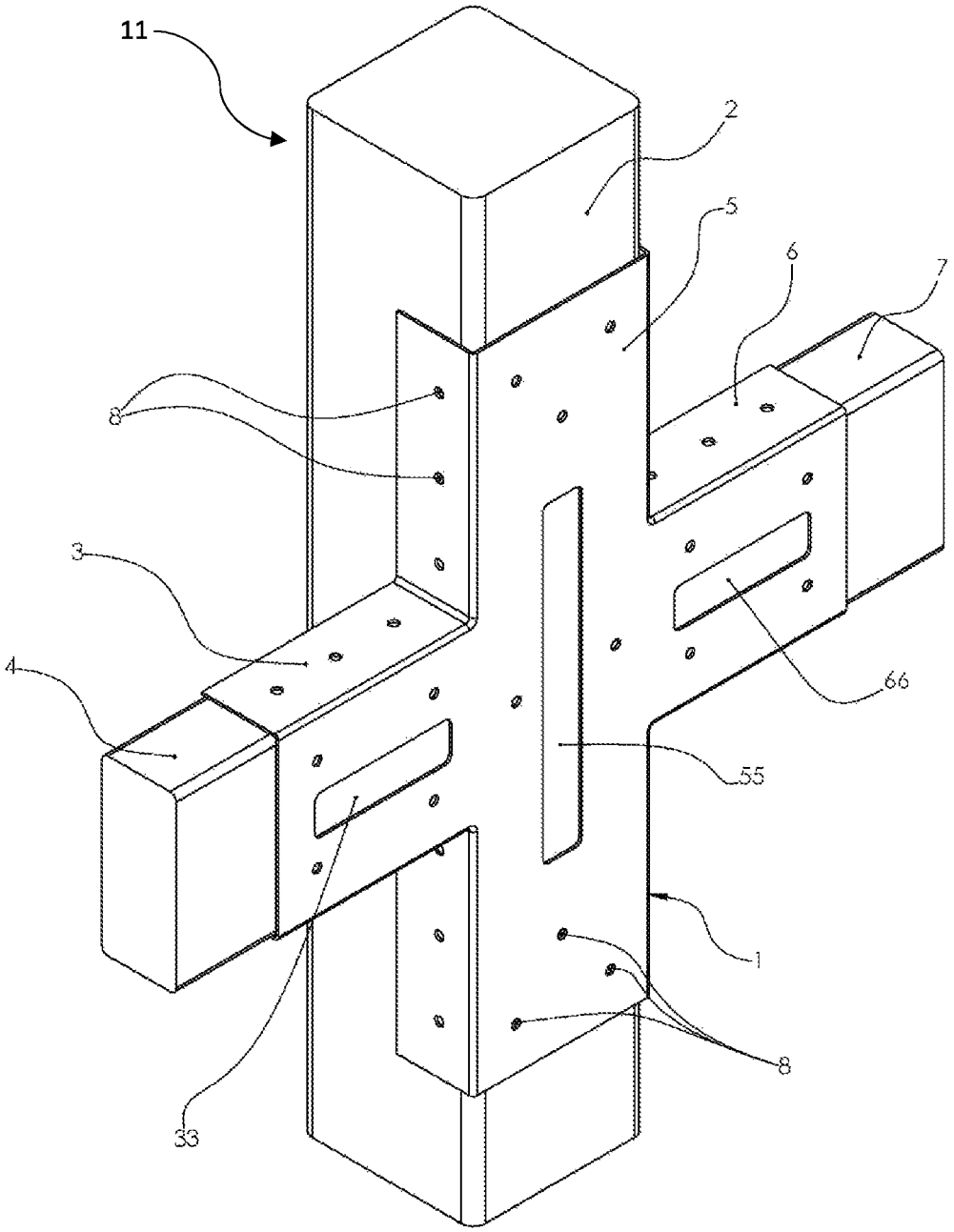
FIG. 3 illustrates an isometric view of a preferred embodiment of a fence assembly including a fence brace, a fence post, and a plurality of linearly disposed fence rails in accordance with the present invention.

Referring to FIG. 3, an embodiment of a fence brace assembly is illustrating comprising fence brace 1 attached to fence 11. Fence brace 1 includes fence post brace member 5 attached to fence post 2 and forming vertical picket fastener slot 55, first fence rail brace member 3 attached to first fence rail 4 and forming first horizontal picket fastener slot 33, and second fence brace member 6 attached to second fence rail 7 and forming second horizontal picket fastener slot 66.

Throughout this specification the fence brace system is mostly described as including a fence post brace member, a first fence rail brace member, and a second fence rail brace member. But for the present invention, fence post brace member 5 may alternatively be referred to as a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein. First fence rail brace member 3 and second fence rail brace member 6 may alternatively be referred to as a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein.

Figure 1:
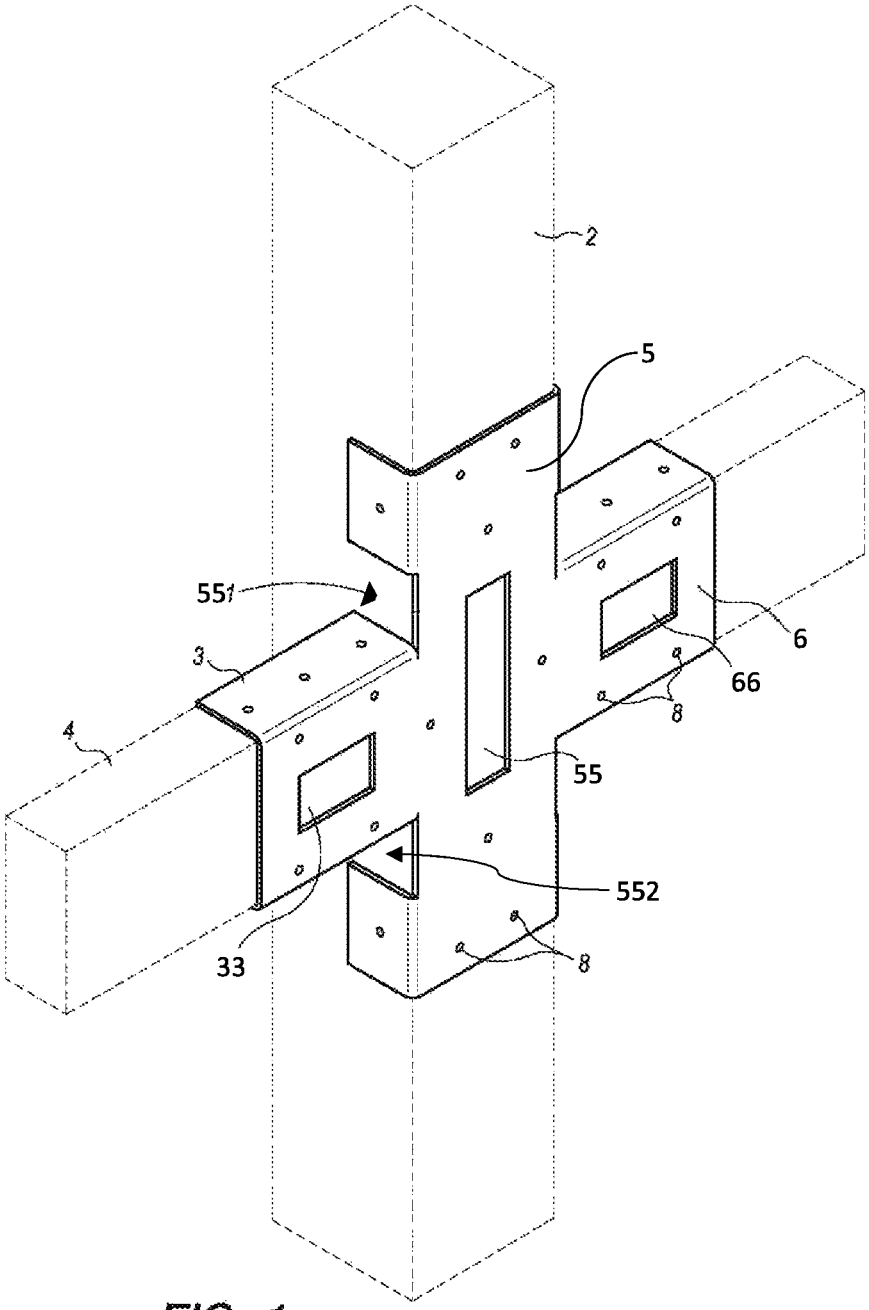
FIG. 1 illustrates an isometric view of an embodiment of a fence brace, wherein one or more cutouts are formed by the fence brace, in accordance with the present invention.

Referring to FIG. 1, an alternative embodiment of the herein disclosed fence brace system is illustrated wherein the rearward-protruding side walls of the opposing upper and lower fence post flanges do not extend all the way to the first and second fence rails. In this embodiment illustrated in FIG. 1, an upper flange cutout 551 is formed on each side of the upper flange and a lower flange cutout 552 is formed on each side of the lower flange. The embodiment illustrated in FIG. 2 differs in that the pair of rearward-protruding side walls extend fully towards first fence rail brace member and the second fence rail brace member.

While the present invention has been illustrated and described herein in terms of a preferred embodiment and several alternatives, it is to be understood that the devices, systems, and assemblies described herein can have a multitude of additional uses and applications. Accordingly, the invention should not be limited to just the particular description and various drawing figures contained in this specification that merely illustrate a preferred embodiment and application of the principles of the invention.

What is claimed is:

1. A fence assembly comprising:

a fence post having a rectangular cross-section;

first and second fence rails, each having a rectangular cross-section; and a fence brace comprising:

a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein, and a plurality of fastener holes disposed within the central wall and side walls of each fence post flange for receiving fasteners to secure the fence post therewith, wherein the pair of rearward-protruding side walls of the upper fence post flange protrude from and extend along the entire planar central wall of the upper fence post flange;

a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein, and a plurality of fastener holes disposed within the central wall and side walls of each fence rail flange for receiving fasteners to secure the fence rails therewith;

a planar central portion of the fence brace disposed between and formed with the central walls of the upper and lower fence post flanges and the central walls of the left and right fence rail flanges, the planar central portion, the central walls of the upper and lower fence post flanges and the central walls of the left and right fence rail flanges being formed from a single planar piece of material;

a vertical picket fastener slot longitudinally-extending through the planar central portion of the fence brace and into the central wall of the upper fence post flange and central wall of the lower fence post flange for receiving a fastener therethrough to affix a picket to the fence post with the fence brace therebetween; and a pair of aligned horizontal picket fastener slots, each longitudinally extending through the central wall of a respective one of the left and right fence rail flanges, orthogonal to the vertical picket fastener slot, for receiving fasteners therethrough to affix a picket to each fence rail with the fence brace therebetween.

2. The fence assembly as recited in claim 1, wherein the fence brace is made of a material selected from a group consisting of steel, stainless steel, galvanized steel, aluminum, plastic, graphite, and composite material.

3. The fence assembly as recited in claim 1, further comprising at least one picket, wherein the picket is fastened to the fence post by passing a screw through the picket and through the vertical picket fastener slot and into the fence post.

4. The fence assembly as recited in claim 1, further comprising at least one picket, wherein the picket is fastened to one of the fence rails by passing a screw through the picket and through one of the horizontal picket fastener slots and into the fence rail.

5. A fence assembly comprising:

a fence post;

first and second fence rails; and a fence brace comprising:

a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein, and a plurality of fastener holes disposed within the central wall and side walls of each fence post flange for receiving fasteners to secure the fence post therewith, wherein the pair of rearward-protruding side walls of the upper fence post flange protrude from and extend along the entire planar central wall of the upper fence post flange;

a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein, and a plurality of fastener holes disposed within the central wall and side walls of each fence rail flange for receiving fasteners to secure the fence rails therewith;

a planar central portion of the fence brace disposed between and formed with the central walls of the upper and lower fence post flanges and the central walls of the left and right fence rail flanges, the planar central portion, the central walls of the upper and lower fence post flanges and the central walls of the left and right fence rail flanges being formed from a single planar piece of material;

a vertical picket fastener slot formed by the planer central portion of the fence brace for receiving a fastener therethrough to affix a picket to the fence post with the fence brace therebetween, wherein the vertical picket fastener slot extends into the central wall of the upper fence post flange and central wall of the lower fence post flange; and a first horizontal picket fastener slot, formed by the left rail flange and orthogonal to the vertical picket fastener slot, for receiving fasteners therethrough to affix a picket to the first fence rail with the fence brace therebetween; and a second horizontal picket fastener slot, formed by the right rail flange and orthogonal to the vertical picket fastener slot, for receiving fasteners therethrough to affix a picket to the second fence rail with the fence brace therebetween.

6. The fence assembly as recited in claim 5, wherein the fence brace is made of a material selected from a group consisting of steel, stainless steel, galvanized steel, aluminum, plastic, graphite, and composite material.

7. The fence assembly as recited in claim 5, further comprising at least one picket, wherein the picket is fastened to the fence post by passing a screw through the picket and through the vertical picket fastener slot and into the fence post.

8. The fence assembly as recited in claim 5, further comprising at least one picket, wherein the picket is fastened to one of the fence rails by passing a screw through the picket and through one of the horizontal picket fastener slots and into the fence rail.

* * * * *